US005170332A

United States Patent [19]

Browne

[11] Patent Number: 5,170,332

[45] Date of Patent: Dec. 8, 1992

[54] LAMP HOUSING

[76] Inventor: Alan R. Browne, 4675 Oberlin Way, Marietta, Ga. 30068

[21] Appl. No.: 703,878

[22] Filed: May 22, 1991

Related U.S. Application Data

[63] Continuation-in-part of Ser. No. 688,063, Apr. 19, 1991, which is a continuation-in-part of Ser. No. 409,406, Sep. 19, 1989, Pat. No. D. 325,263.

[51] Int. Cl.[5] ..... F21V 15/02; F21V 29/00

[52] U.S. Cl. ..... 362/376; 362/264; 362/373; 362/391; 362/399; 362/363

[58] Field of Search ..... 362/373, 376, 377, 378, 362/363, 368, 391, 399, 400, 260, 264, 218

[56] References Cited

U.S. PATENT DOCUMENTS

| | | | |
|---|---|---|---|
| 974,226 | 11/1910 | Benjamin | 362/376 |
| 1,210,263 | 12/1916 | Benjamin | 362/363 |
| 1,476,036 | 12/1923 | Benjamin | 362/376 |
| 1,760,618 | 5/1930 | Woodhead | 362/399 |
| 1,771,640 | 7/1930 | Kollath | 362/378 |
| 1,791,625 | 2/1931 | Kollath | 362/378 |
| 2,096,604 | 10/1937 | Bissell | 362/376 |
| 2,228,680 | 1/1941 | Tornblom | 362/376 |
| 2,286,891 | 6/1942 | Bissell | 362/363 |
| 2,514,164 | 7/1950 | Popp et al. | 362/363 |
| 3,364,346 | 1/1968 | Gunn | 362/264 |
| 3,675,007 | 7/1972 | Appleton et al. | 362/363 |
| 4,141,062 | 2/1979 | Trueblood | 362/378 |
| 4,275,435 | 6/1981 | Dorn | 362/368 |
| 4,369,487 | 1/1983 | Carlow | 362/378 |
| 4,425,609 | 1/1984 | Grindle | 362/376 |
| 4,513,359 | 4/1985 | Nielson | 362/373 |
| 4,885,670 | 12/1989 | Baake | 362/376 |
| 4,931,023 | 6/1990 | Browne | 439/459 |

OTHER PUBLICATIONS

A reprint labelled "Crouse-Hinds ECM Code Digest" (bearing a copyright date of 1989).

A brochure of the Stewart R. Browne Manufacturing Company entitled "The Leader in Portable Safety Lighting".

Underwriters Laboratories, Inc. Standard 781, "Portable Electric Lighting Units for Use in Hazardous (Classified) Locations" (as amended Jul. 5, 1989).

*Primary Examiner*—Ira S. Lazarus
*Assistant Examiner*—Y. Quach

[57] ABSTRACT

A lamp housing having a non-metallic exterior guard and handle assembly and threaded relief passages is disclosed. The exterior guard comprises a series of flared nylon spokes spaced about the circumference of the globe for cushioning the lamp and its tempered glass globe during impact with hard surfaces. One end of each spoke converges to a common location at the top of the lamp housing, while the other terminates along the circumference of a ring concentric with the lower portion of the globe. The lamp housing also includes threaded joints forming helical relief passages for permitting hot, pressurized gasses, should any be present, to cool before exiting the housing. Other features of the invention include a strain relief structure for relieving stresses on electrical connections with external cables and a hook for permitting the structure to be fixed about appropriate objects. The non-metallic exterior guard, threaded relief joints, and other insulating components make the present invention well-suited for use in wet, corrosive, or combustible surroundings.

6 Claims, 2 Drawing Sheets

LAMP HOUSING

CROSS-REFERENCE TO RELATED APPLICATIONS

This application is a continuation-in-part of design patent application Ser. No. 07/688,063, filed Apr. 19, 1991, entitled "Lamp Housing," which application is a continuation-in-part of design patent application Ser. No. 07/409,406, filed Sep. 19, 1989, entitled "Electrical Cord Strain Relief Structure," each of which applications is incorporated herein in its entirety by this reference.

FIELD OF THE INVENTION

The present invention relates to lamp housings and more particularly to structures for housing fluorescent lamps such as portable industrial work lights used, typically, in hazardous environments.

BACKGROUND OF THE INVENTION

Fluorescent electric lights are used for illuminating a variety of environments where combustible materials may be present because fluorescent lamps typically produce less heat during operation than incandescent lamps. Portable electric lights are utilized in other hazardous environments as well, often in the presence of wet or corrosive materials. To combat the stresses induced by these environments and to avoid hazards caused by breakage, existing portable work lights typically include metal guards for protecting the electric lamps inside. One example of such a light, the Model XP65 Fluorescent Portable Inspection Light of the Stewart R. Browne Manufacturing Company, includes a guard having intersecting flat metal bars forming a protective grid about an elongated fluorescent tube. Other work lights comprise a protective glass globe surrounding the electric lamp.

Utilizing metal or similar electrically-conductive guards does not preclude the possibility of electrical arcs or shocks in charged or wet environments, however. Metal guards additionally may spark should the lights be dropped onto or otherwise impact certain substances, potentially igniting flammable materials or combustible atmospheric gasses. Although less likely to conduct electricity, many glass protective surfaces may break if dropped or impacted with sufficient force, exposing the interior lamps to the hazardous environments and vice-versa. Other glass-globed structures fail to insulate the electric lamps from their environments, permitting atmospheric gasses to contact the lamps with potentially dangerous results. Recognizing these and other perils present in artificially illuminating hazardous environments with electric lamps Underwriters Laboratories, Inc. ("UL") has promulgated Standard 781 for "Portable Electric Lighting Units for Use in Hazardous (Classified) Locations" (which standard is incorporated herein in its entirety by this reference). Until recently, however, only metallic guards were considered sufficiently protective and durable to meet the UL Standard.

SUMMARY OF THE INVENTION

The present invention provides a lamp housing having a durable, non-metallic protective exterior guard and handle assembly. Designed to cushion the lamp and its tempered glass globe during impact with hard surfaces, the exterior guard comprises a series of flared nylon spokes spaced about the circumference of the globe. One end of each spoke converges to a common location at the top of the lamp housing, while the other terminates along the circumference of a ring concentric with the lower portion of the globe.

The lamp housing also includes threaded joints forming helical paths through which hot, pressurized gasses, should any be present within the housing, must travel. The helical relief paths permit the gasses to cool before contacting the external environment, decreasing, in appropriate circumstances, the probability of igniting explosive atmospheric vapors. Other features of the lamp housing comprise a strain relief structure for relieving stresses on electrical connections and a hook for permitting the structure to be fixed about appropriate objects when necessary or desired. The non-metallic exterior guard, threaded relief joints, and other insulating components make the present invention well-suited for use in wet, corrosive, or combustible surroundings in accordance with UL Standard 781.

It is therefore an object of the present invention to provide a durable lamp housing having an exterior guard for cushioning and protecting the lamp and its glass enclosure from impacts with hard surfaces.

It is an additional object of the present invention to provide a lamp housing having an exterior guard comprising multiple flared nylon spokes.

It is a further object of the present invention to provide threaded relief paths through which gasses travel before contacting the external environment.

It is another object of the present invention to provide an insulated, non-metallic fluorescent lamp housing for use in wet, corrosive, or combustible environments.

Other objects, features, and advantages of the present invention will become apparent with reference to the remainder of the written portion and the drawings of this application.

DETAILED DESCRIPTION

Figures 1, 2:
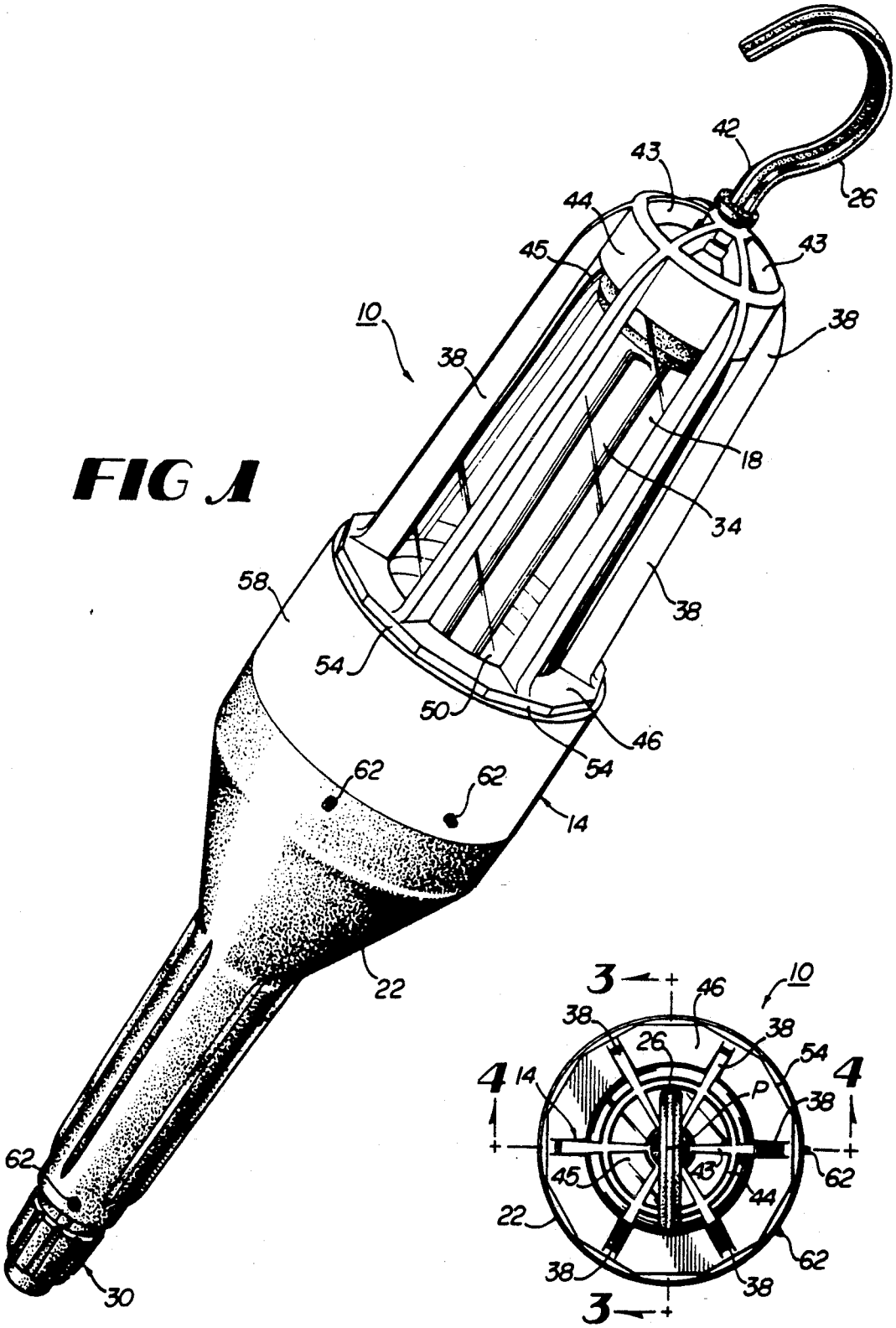
FIG. 1 is a perspective view of the light of the present invention.
FIG. 2 is a top plan view of the light of FIG. 1.

FIG. 1 illustrates portable light 10 of the present invention. Light 10 generally includes exterior guard 14, globe 18, handle 22, hook 26, and strain relief structure 30. Exterior guard 14 and globe 18 shield lamp 34 (such as a fluorescent lamp) from the environment of housing 10, decreasing the likelihood of breaking lamp 34 (and globe 18) and thereby igniting any combustible atmospheric gasses present. Handle 22 facilitates carrying of light 10, and hook 26 permits light 10 to be fixed about appropriate devices such as rods, pipes, or other objects when necessary or desired. Strain relief structure 30 protects electrical cable 36 (FIGS. 3–4) from excessive bending at the point where cable 36 enters structure 30. If desired, light 10 may be made essentially airtight or watertight according to various industry and government standards.

Detailed in FIGS. 1–4 is an embodiment of external guard 14 of the present invention. Guard 14 comprises six bars or spokes 38 (see FIG. 2), each of which spokes 38 diverges from a common aperture P on guard 14 surrounding the neck 42 of hook 26. Each spoke 38, therefore, forms an angle of approximately 60° with its adjacent spokes 38 about aperture P in a plane tangent to the upper surface of guard 14 (the plane of the page containing FIG. 2). The upper portions 43 of spokes 38 also are integrally formed with band 44 of guard 14, which provides lateral stability for spokes 38 and surrounds, or caps, much of the upper portion 45 of globe 18.

From aperture P, spokes 38 traverse the length of globe 18, terminating along the circumference of a ring 46 concentric with the lower portion 50 of globe 18. As shown in FIGS. 1-2, the exterior of ring 46 may be dodecagonal (or otherwise multi-sided) if desired rather than circular in shape. If the exterior of ring 46 is dodecagonal, the terminating points of the six spokes 38 may be designed to form flanges bisecting alternating sides 54 of the ring 46, thereby increasing the overall strength and stability of guard 14. The widths of spokes 38 also flare as the spokes 38 diverge from aperture P to assist in cushioning globe 18 (and lamp 34) from impact while conforming more closely to the flared shape of globe 18 and the size of ring 46. The resulting structure of guard 14, therefore, resembles a bell-shaped cage for encompassing and protecting globe 18.

In one embodiment of guard 14 meeting UL Standard 781 for use in hazardous locations, guard 14 is integrally formed with ring 46 and a cylindrical lower guard structure 58 and, like the exterior surface of handle 22 and hook 26, is molded of Zytel TM 801 ST nylon manufactured by the E. I. duPont deNemours & Company. Strain relief structure 30 and exterior screws 62 similarly may be made of nylon and globe 18 of tempered glass so that light 10 may be designed to have no exposed metal parts during (normal) operation. Replacing exposed metal with nylon or similar electrical insulators decreases the possibility of arcing or shorting which otherwise might be caused by objects contacting the exposed metal surface. Integrally molding guard 14 (including spokes 38 and band 44) with ring 46 and lower guard structure 58 also strengthens the resulting assembly, providing additional protection from impact forces for globe 18 and lamp 34. Using nylon also improves the shock absorbing capabilities of guard 14.

Figure 3:
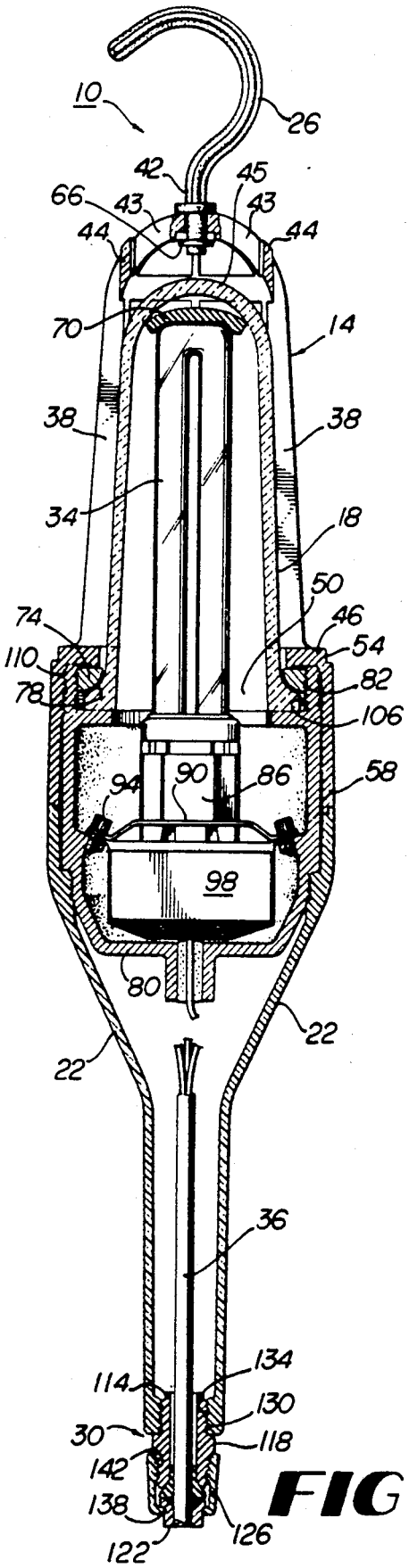
FIG. 3 is a cross-sectional view of the light of FIG. 1 taken along lines 3—3 of FIG. 2.
Figure 4:
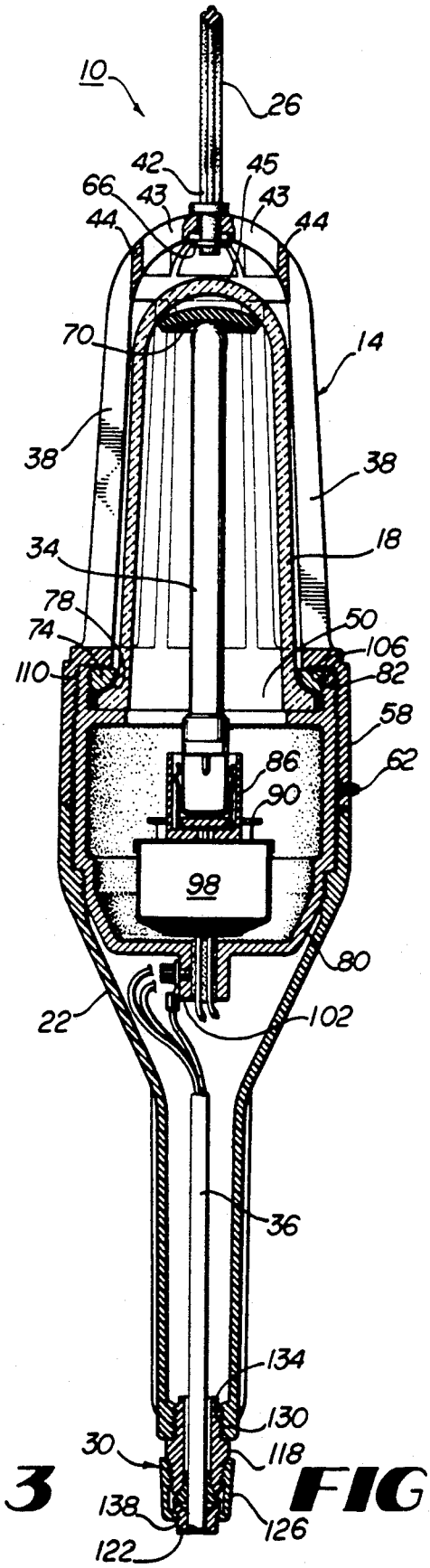
FIG. 4 is a cross-sectional view of the light of FIG. 1 taken along lines 4—4 of FIG. 2.

FIGS. 3-4 detail the interior of light 10. Among the items illustrated in FIG. 3 are hook retainer 66, lamp cap 70, globe retaining ring 74, gasket 78, and lamp retainer 80. Hook retainer 66, which may be a nylon clip or similar retaining structure, secures the neck 42 of hook 26 within guard 14. Lamp cap 70, which may be made of foam or other cushioning material, is shown in FIGS. 3-4 as positioned within globe 18 between lamp 34 and the upper portion 45 of the globe 18 to prevent contact between the two. Threaded globe retaining ring 74 engages interior threads 82 of lamp retainer 80 and, together with gasket 78, functions to retain the flanged base of globe 18 in place within light 10 and thereby insulate lamp 34 from the environment surrounding light 10. In an embodiment of light 10 meeting UL Standard 781, globe retaining ring 74 is made of aluminum and gasket 78 of aramid fiber.

Also shown in FIGS. 3-4 are lamp socket 86, lamp retaining bracket 90, interior set screws 94, and ballast 98. Socket 86, bracket 90, and set screws 94 secure lamp 34 within globe 18, while ballast 98 permits operating a fluorescent lamp (such as the twin tube compact fluorescent lamp shown in FIGS. 1 and 3-4) as lamp 34. Other retaining and operating means may be used as appropriate for alternative lamps 34, however. Illustrated partially schematically in FIG. 4 is a terminal block 102 in which wires forming cable 36 connect electrically with ballast 98 and lamp 34. Because exterior threads 106 of lamp retainer 80 engage interior threads 110 of cylindrical lower guard structure 58, light 10 may be disassembled with minimal effort when necessary or appropriate.

Light 10 also is designed to allow hot, explosive vapors, should any be present within light 10, to cool before escaping to the external environment. Threads 82, 106, and 110, together with threaded globe retaining ring 74 (and gasket 78), provide threaded joints through which any pressurized vapors must travel before exiting light 10. Retaining ring 74 and threads 82, when engaged, provide a first threaded joint forming a first helical relief path through which escaping gasses must travel. Threads 106 and 110, when engaged, similarly provide a second helical path. Each of these paths permits the hot gasses to cool before escaping into the environment surrounding light 10, decreasing, in certain circumstances, the likelihood that environmental vapors will ignite when contacted by the escaping gasses.

The components of strain relief structure 30 similarly are illustrated in FIGS. 3-4. Generally comprising strain relief structure 30 are body 114, lock nut 118, grommet 122, and collar 126. Exterior threads 130 of body 114 engage interior threads 134 of handle 22, securing (with lock nut 118) strain relief structure 30 to handle 22 positioned in the end 138 of body 114 opposite handle 22 is grommet 122, Which serves to hold cable 36 firmly in place. Interior threads 142 of collar 126 similarly engage exterior threads 130 of body 114, surrounding and protecting grommet 122. Other cord strain relief structures may be used in place of structure 30 when desired, however, including those disclosed in U.S. Pat. No. 4,931,023, issued Jun. 5, 1990, entitled "Cord Strain Relief Device and Associated Lamp," which patent is incorporated herein in its entirety by this reference.

Nominal dimensions of selected components of an embodiment of light 10 consistent with UL Standard 781 include a minimum thickness of 0.210 inches of tempered glass for globe 18, while nylon exterior guard 14 is 8 ¾ inches high and 4 3/16 inches in diameter. In this embodiment globe retaining ring 74 has outside and inside diameters of 3 ½ and 2.72 inches, respectively, and may be 0.40 inches thick. Gasket 78, placed between the exterior of globe 18 and globe retaining ring 74, may have an outside diameter of 3 ¼ inches. Finally, handle 22 is approximately 9.05 inches long, 4 ¼ inches in diameter, and at least 0.125 inches thick in a UL-approved embodiment of the present invention. None of these specified materials or dimensions is critical to the invention, however, and any or all may be altered as desired to accommodate, for example, different lamps 34. Greater or fewer than six spokes 38 similarly may be used in connection with exterior guard 14. Additional modifications will be apparent to those of ordinary skill in the art and may be made without departing from the scope or spirit of the invention.

I claim:

1. A portable, elongated fluorescent work light for use in hazardous environments comprising:

a. a nylon exterior guard having an upper surface ad comprising:
i. six flared spokes adjacent one to another and traversing at least a portion of the length of the light, each spoke comprising:
A. a first end having a first width at least partially defining an aperture and describing with the first end of each adjacent spoke an angle of approximately 60° in a plane tangent to the upper surface;
B. a second end having a second width greater than the first width for forming a flange; and
C. a segment intermediate the first and second ends of the spoke;
ii. a band integrally formed with and connecting the segments of the plurality of spokes; and
iii. a substantially ring-shaped base integrally formed with the second ends of the plurality of spokes and having a threaded interior surface;
b. a handle having a nylon exterior surface and abutting the exterior guard during operation of the light;
c. means, connected to the handle and exterior guard, for securing an electric lamp within the light and insulating the electric lamp from the environment surrounding the light during normal operation, and including an electrical cable comprising:
i. a retainer, connected to the handle and exterior guard, comprising:
A. a threaded exterior surface engaging the threaded interior surface of the base and thereby forming a first helical joint, which joint functions as a portion of a relief path for permitting passage of sufficiently pressurized gas from within the light to the environment surrounding the light while permitting the gas to cool;
B. an interior ledge; and
C. a threaded interior surface integrally formed with and normal to the ledge;
ii. a socket, attached within the retainer, for receiving the electric lamp;
iii. a globe having a flanged base abutting the interior ledge of the retainer for surrounding the electric lamp;
iv. a threaded retaining ring for securing the flanged base of the globe within the retainer and insulating the electric lamp from the environment surrounding the retainer during normal operation of the light, which threaded retaining ring engages the threaded interior surface of the retainer and thereby forms a second helical joint, which joint functions as another portion of a relief path; and
v. a gasket positioned intermediate the threaded retaining ring and the flanged base of the globe;
d. a foam cap placed within the globe for wedging between the globe and the electric lamp;
e. a nylon hook having a neck for receipt by the aperture of the exterior guard;
f. a nylon clip placed about the neck for securing the neck within the exterior guard; and
g. means for relieving stresses on the electrical cable, comprising:
i. a base portion connected to the handle assembly and having two ends defining openings for receiving a portion of the electrical cable;
ii. a grommet positioned in one end of the base portion; and
iii. a collar attached to the base portion for surrounding at least a portion of the grommet.

2. An elongated, portable light comprising:
a. a retainer, for securing an electric lamp within the light, comprising interior threads and first and second exterior threads;
b. a non-metallic handle comprising interior threads engaging the first exterior threads of the retainer;
c. a non-metallic guard for protecting the lamp, comprising interior threads for engaging the second exterior threads of the retainer and thereby forming a first helical joint, which joint functions as a relief path for permitting passage of sufficiently pressurized gas from within the light to an environment surrounding the light while permitting the gas to cool; and
d. means for insulating the electric lamp from the environment surrounding the retainer, which means engages the interior threads of the retainer to form a second helical joint, which joint functions as a continuation of the relief path.

3. A light according to claim 2 in which the insulating means comprises:
a. a socket, connected to the retainer, for receiving the electric lamp;
b. a globe having a flanged base abutting the retainer for surrounding the electric lamp;
c. a threaded retaining ring engaging the interior threads of the retainer for securing the flanged base of the globe within the retainer; and
d. a gasket positioned intermediate the threaded retaining ring and the flanged base of the globe.

4. A light according to claim 3 further comprising means, connected to the handle, for relieving stresses on a cable providing electricity to the electric lamp.

5. A light according to claim 4 in which the stress relieving means comprises:
a. a base portion connected to the handle and having two ends defining openings for receiving a portion of the cable;
b. a grommet positioned in one end of the base portion; and
c. a collar attached to the base portion for surrounding at least a portion of the grommet.

6. A light according to claim 5 in which the guard further comprises:
a. an upper surface;
b. a plurality of flared spokes adjacent one to another and traversing at least a portion of the length of the light, each spoke comprising:
i. a first end having a first width at least partially defining an aperture and describing with the first end of each adjacent spoke an angle of approximately 60° in a plane tangent to the upper surface;
ii. a second end having a second width greater than the first width; and
iii. a segment intermediate the first and second ends of the spoke;
c. a band integrally formed with and connecting the segments of the plurality of spokes; and
d. a substantially ring-shaped base integrally formed with the second ends of the plurality of spokes.

* * * * *

UNITED STATES PATENT AND TRADEMARK OFFICE

CERTIFICATE OF CORRECTION

PATENT NO. : 5,170,332

DATED : December 8, 1992

INVENTOR(S) : Alan R. Browne

It is certified that error appears in the above-identified patent and that said Letters Patent is hereby corrected as shown below:

Column 1, line 54, insert a comma after the word "lamps"

Column 4, line 33, insert a period after "handle 22"

Column 4, line 33, delete the word "positioned" and substitute --Positioned-- therefor Column 4, line 34, delete the word "Which" and substitute --which-- therefor Column 5, line 1, delete the word "ad" and substitute --and-- therefor Signed and Sealed this Twenty-sixth Day of October, 1993

*Attest:*

*Attesting Officer*

Bruce Lehman

BRUCE LEHMAN

*Commissioner of Patents and Trademarks*